US006146243A

United States Patent [19]

Imahashi

[11] Patent Number: 6,146,243

[45] Date of Patent: Nov. 14, 2000

[54] METHOD AND APPARATUS FOR FINISHING WORKS MAGNETICALLY BY GENERATING ALTERNATING MAGNETIC FIELDS

[75] Inventor: Takahiro Imahashi, *deceased, late of Tokyo, Japan, by Noboru Imahashi, legal representative*

[73] Assignee: Imahashi Mfg., Co., Ltd., Tokyo, Japan

[21] Appl. No.: 08/996,908

[22] Filed: Dec. 23, 1997

[30] Foreign Application Priority Data

Dec. 24, 1996 [JP] Japan ..... 8-344326

[51] Int. Cl.[7] ..... B24B 1/00; B24B 31/00

[52] U.S. Cl. ..... 451/32; 451/36; 451/104; 451/113

[58] Field of Search ..... 451/32, 36, 104, 451/106, 113

[56] References Cited

U.S. PATENT DOCUMENTS 4,821,466 4/1989 Kato et al. .

5,044,128 9/1991 Nakano .

5,419,735 5/1995 Imahashi et al. .

5,662,516 9/1997 You .

*Primary Examiner*—Timothy V. Eley

*Attorney, Agent, or Firm*—Wenderoth, Lind & Ponack, L.L.P.

[57] ABSTRACT

A method and an apparatus are disclosed wherein works may be finished magnetically by media by utilizing the interaction of the works and media placed within the generated alternating magnetic fields. A method of finishing works magnetically comprises generating multiple alternating magnetic fields and combining them to provide combined alternating magnetic fields covering a specific extensive region and placing media and works in their free motion within those alternating magnetic fields. An apparatus for finishing works magnetically comprises a plurality of alternating magnetic filed generator units each including a plurality of magnets, wherein any combination of those units provides combined alternating magnetic fields within which works and media are placed, with at least the media being placed in its free motion.

8 Claims, 12 Drawing Sheets

METHOD AND APPARATUS FOR FINISHING WORKS MAGNETICALLY BY GENERATING ALTERNATING MAGNETIC FIELDS

FIELD OF THE INVENTION

The present invention relates to a method and apparatus for finishing works magnetically by generating alternating magnetic fields, and more particularly to a method and apparatus employing a plurality of alternating magnetic filed generator units that may be configured in any combination for producing combined alternating magnetic fields covering an extensive region in which works may be finished magnetically. Any dead points, or magnetically inactive points, that may occur between the alternating magnetic field generator units may be eliminated so that even large, complicatedly configured works can be finished under the uniformly distributed magnetic action.

DESCRIPTION OF THE PRIOR ART

It is well known to the art that media and works are made to flow by generating alternating magnetic fields, and an apparatus for finishing works magnetically in the above manner (as disclosed in U.S. Pat. No. 5,419,735). It is also known that a number of improvements have been made to the arrangement of permanent magnets on a rotating plate in order to increase the productivity and finishing efficiency (as disclosed in U.S. Pat. No. 5,611,725).

According to the conventional magnetic finishing apparatus of the type as mentioned above, the area or region that the produced alternating magnetic fields can cover is limited considerably, and sizes and shapes of works that can be processed are limited accordingly. It is impossible to vary the action of the magnetic filed, depending upon the particular shape and size of works to be finished. In fact, such works cannot be finished. By improving the arrangement of the permanent magnets so that the uniform magnetic fields can be generated, as disclosed in the U.S. Pat. No. 5,611,725, the finishing efficiency may be increased, and the high quality products may be provided. In this case, however, the shape and size of works are well limited. The disk plate on which magnets are mounted may be larger, but it is found that a greater difference may occur in the strength of the alternating magnetic fields between the center and peripheral areas of the disk plate.

SUMMARY OF THE INVENTION

In order to solve the problems associated with the prior art as described above, the present invention provides a plurality of alternating magnetic field generator units that may be arranged in any combination, and may eliminate any dead points, or magnetically inactive areas, of the magnetic fields that may otherwise occur between the each magnetic field generator units.

The magnet fields that are generated according to the present invention covers an extensive area or region in which large works can be processed with higher productivity and finishing efficiency. The result is the good quality product.

The present invention provides a method of finishing works magnetically by generating alternating magnetic fields, wherein a plurality of alternating magnetic fields are generated and may be combined to cover an extensive region within which media and works being processed therewith may be placed in their free motion. Alternatively, the present invention provides a method of finishing works magnetically by generating alternating magnetic fields, wherein a plurality of alternating magnetic fields are generated and may be combined to cover an extensive region within which media and works being processed therewith may be placed in their free motion, and wherein the media and works may be forced to change their relative position with regard to the generated combined alternating magnetic fields.

The present invention provides an apparatus for finishing works magnetically by generating alternating magnetic fields, wherein it comprises a plurality of alternating magnetic field generator units including magnets mounted on a rotating plate, wherein any combination of those alternating magnetic field generator units may be arranged in parallel and combined to generate combined alternating magnetic fields in which media and works being processed therewith may be placed, with at least media being moving freely.

Alternatively, the present invention provides an apparatus for finishing works magnetically by generating alternating magnetic fields, wherein it comprises a plurality of alternating magnetic field generator units including magnets mounted on a rotating plate, wherein any number of those alternating magnetic field generator units may be arranged in parallel and combined to generate combined alternating magnetic fields within which media and works being processed therewith may be placed, with at least media being moving freely, and wherein it further includes means for forcing a mass of the abrasive media and works to change their relative position with regard to the generated combined alternating magnetic fields. Particularly, the means for forcing may include a rocking means, a rotating means, or a combination of both for rocking and/or rotating a plate on which the magnets are mounted.

Furthermore, the present invention provides an apparatus for finishing works magnetically by generating alternating magnetic fields, wherein it includes a magnet support plate on which plurality of magnets for generating alternating magnetic fields are mounted. The magnet support plate may be rotatable or may be rockable on which a container containing media and works being processed therewith may be placed. Alternatively, the apparatus may comprise a frame structure including a rectangular bottom plate and a lateral plate extending vertically on each of the lateral sides, or a lateral plate extending vertically on each of the front and rear sides and each of the lateral sides. The frame structure may have the shape including one side open, or may have the L shape, rectangular shape of polygonal shape. Then, magnets may be mounted on the rear side of each of the frame structure so that those magnets can provide alternating magnet fields. A rocking means may be added to the frame structure.

According to the present invention, the relative position of the mass of media and works with regard to the generated alternating magnetic fields may be changed in the following ways. A first way is to move the mass and works relative to the alternating magnetic fields, a second way is to move the generated alternating magnetic fields relative to the mass and works, and a third way is to move both relative to each other. Which way is to be chosen may depend upon the particular size and shape of works being processed and the particular condition of the alternating magnetic field generator units. Thus, the apparatus may include means for performing any of the above methods.

Each of the alternating magnetic field generator units may include permanent magnets (rotational) or electromagnets (non rational) that are placed in their appropriate positions.

When the units are rotated, they provide alternating magnetic fields that are determined by some factors such as the relative position and the number of rotations. Thus, those factors may be determined experimentally so that they can cause the media mass to flow most efficiently. It may be understood that it is meaningless to cause any complicate change in the magnetic fields under which the media mass cannot follow such change.

In the prior art, the alternating magnetic fields are generated by placing magnets of identical size and shape on a horizontal plate (that is, on the same plane) in the specific manner. As an alternative to this arrangement, the adjacent magnets may be staggered relative to each other in the vertical direction to provide the three-dimensional change in the magnet arrangement. In this way, the shape of the generated magnetic field may be varied, or the magnetic flux may be oriented in any desired direction.

Magnetic media that may be used for the purpose of the present invention may be of different shapes and materials. Typically, pins of stainless steel of 0.2 to 1.5 mm may be used. Those pins are semi-rounded on the opposite ends thereof. The pins, which are placed in the magnetic fields, will spin vigorously in response to any rapid change in the magnetic fields, and will be given a large kinetic energy. Then, the pins strike against the works, which are then surface-finished by the so-called shot peening effect. At this time, the varnishing effect may also be provided. When any abrasive media is added, the works may be polished or finished by the said abrasive media FIG. 12(*a*) and FIG. 12(*b*) illustrate how the magnetic pins spin when they are placed in the alternating magnetic fields, and are given the kinetic energy which causes the pins to strike against the works.

Given the mass m of a pin and its velocity v, the kinetic energy T is expressed in the simple equation, as follows:

$$T=\frac{1}{2}mv^2$$

The velocity v of a pin varies in proportion to the strength of the magnetic flux and the rate of change in the magnetic field, and varies in reverse proportion of the viscosity of a fluid flowing therein. Once a particular pin strikes against a particular work, it imparts all of the kinetic energy to the work. As the magnetic field is changing rapidly, it causes the same pin to spin over again, striking against the work in all directions. Thus, the work is given the kinetic energy over again, and can be finished in a very short time. In the shot peening process using the pneumatic pressure, once a particular media are blown against a particular work, it will cease to perform the role as media. If the work continues to be finished, new additional media must be blown.

FIG. 13 presents the results of the experiment that took place to demonstrate how stainless steel pins as media strike against works when they are used in the permanent magnet barrel finishing machine. For testing purposes, a cylindrical aluminum work having a diameter of 20 mm and a length of 30 mm is used, which is covered with a thin paper sheet around the outer surface over which a carbon paper sheet is attached. Those works are placed in a container in which 0.5 mm stainless steel pins are also placed. The works are finished by the pins striking against the works in the air for two minutes. FIG. 13 shows the traces followed by the pins striking against the works.

More specifically, in FIG. 13, round spots represent the points at which the pin struck against the work, which is equivalent to the shot peening using the ball, and elongated marks indicate that the varnishing effect occurred but no removal occurred.

There are two modes of generating alternating magnetic fields, the permanent magnet mode and the electromagnet mode. In the permanent magnet mode, powerful permanent magnets are mounted on a magnet support plate which can rotate. In the electromagnet mode, an iron core carries a coil through which alternating current is made to flow to generate alternating magnetic fields. Both modes have merits and demerits, and have the irrespective particular applications. More often, the permanent magnet mode is used for the practical use.

FIG. 14(*a*) illustrates the barrel finishing machine employing the permanent magnet mode. Alternating magnetic fields may be generated by driving a motor to rotate the magnet support plate carrying the permanent magnets. Typically, the magnet support may be rotated at 500 to 400 rpm.

FIG. 14(*b*) illustrates the barrel finishing machine employing the electromagnet mode. As shown, there is no rotating part because the alternating magnetic fields can be generated simply by conducting alternating current through the coil.

Both in FIG. 14(*a*) and FIG. 14(*b*), there is a top plate made of nonconductive, nonferromagnet material which is located above the region where the alternating magnetic flux is produced. A container, which is also made of nonferromagnetic material, contains works, barrel media, water, and liquid compound, and is placed on the top plate. Then, the machine is operated so that the alternating magnetic fields may be produced for finishing works magnetically. For some particular works, the dry finishing using no water may be performed.

FIG. 15 illustrates the cylindrical type barrel finishing machine employing the electromagnet mode. This machine consumes a great deal of power, and uses the three-phase alternating power supply. The power factor of the circuit must be varied to reduce the value of current through the circuit, and the forced cooling is required as a large amount of heat is produced.

FIG. 16(*a*) and FIG. 16(*b*) are diagrams shown curves of the magnetic flux as measured by moving the gauss meter across the top plate in the radial direction for the barrel finishing machine employing the permanent magnet mode. The curves FIG. 16(*a*) and FIG. 16(*b*) are obtained by measuring the magnetic flux during the rotation of the magnet support plate. Specifically, the curve FIG. 16(*b*) represents the root-mean square (RMS) values for the magnetic flux as actually measured, and the curve FIG. 16(*a*) is plotted by actually measuring the value of DC with NS cancelled. From the curve FIG. 16(*a*), it may be understood that N and S components of the DC value might cause a random motion in the media mass. Therefore, the DC value including NS ordered regularly is equal to zero (0), that is, a straight horizontal line. A complete alternating magnetic field may thus be provided, causing the certain directional flow of the media mass.

FIG. 17 shows, for the cylindrical type barrel finishing machine employing the electromagnet mode, the RMS values obtained by measuring the instantaneous magnetic flux in the coil by using the gauss meter. It may be seen that a substantially uniform alternating magnetic field may be produced inside the core by the magnetic flux rotating at a high speed, and in particular, higher values are exhibited in the inner edge of the core.

The manner of using the magnetic barrel finishing machine is very simple. Firstly, magnetic media, works, water and compound are placed into a nonferromagnetic container, which may be placed on or inside the machine during the operation for a certain time. Unlike the usual magnetic finishing, media and works are not in direct touch with the magnets. As magnetic media, pins of 0.2 to 1.5 mm in diameter may be used. In some cases, stainless steel balls of 0.2 to 2.0 mm in diameter may also be included as supplemental media. In this case, the combination may be varied, depending on the material, type and the like of works being processed. As one typical example, the proportions of works, media, water and compound are given in Table 1 below.

TABLE 1

Proportions of Works, Media, Water and Compound in Container

| Container D × W (mm) | Works (g) | Steel Pins (g) | Steel Balls (g) | Water (mm) | Compound (cc) |
|---|---|---|---|---|---|
| ϕ 110 × 100 | 75 | 60–75 | 6–8 | 30 (230 cc) | 2–4 |
| ϕ 140 × 125 | 150 | 120–150 | 12–15 | 38 (450 cc) | 4–7 |
| ϕ 170 × 140 | 220 | 180–220 | 18–22 | 42 (800 cc) | 8–15 |
| ϕ 280 × 145 | 500 | 250–500 | 25–50 | 43 (2300 cc) | 20–40 |

(D: depth of container, W: width of container)

The total amount of works, media, water and compound is preferably equal to 30% of the container capacity, as given in Table 1. The diameter of stainless steel pins may be varied, depending on the type of works, the purpose of finishing, etc. Larger diameter pins provide the higher finishing efficiently but the resulting works may contain larger traces by impingement, while smaller diameter pins may finish works with smaller traces by impingement and may finish them to details, but the finishing efficiency may be lowered. The finishing process may be performed for 5 to 30 minutes. It would take longer when harder works are processed. For heavy works made of ferromagnetic material, care should be taken to ensure that the works are kept floating within the container. The choice of the finishing conditions may be based on the respective specific values obtained by the experiments.

Metal parts may be usually finished by adding water and compound. The compound has the effect of lubricating, degreasing, diffusing, and polishing works and media. Works of ceramics or the like may be finished by adding other abrasive media. In this case, the added abrasive media enters between the works and ferromagnetic media, and may polish works by the varnishing action of the ferromagnetic media.

The flat-type barrel finishing machine employing the electromagnet mode may be used essentially in the same manner as that employing the permanent magnet mode, but it would take longer for completing finishing process. For the cylindrical-type barrel finishing machine, the container must be of a cylindrical type but the finishing can be completed in a shorter time.

The following has been found from the results of the experiments. That is, when works that are harder than the stainless steel pins used as ferromagnetic media are to be finished, any abrasive media must be added for other purposes than debarring more or less. This applied to the crape finishing.

Using the ferromagnetic media in the powerful alternating magnetic fields provides a new surface-finishing process of the present invention that makes the surface finishing more efficient. Particularly, this process not simply increases the productivity, but also makes the fine finishing possible that can produce the satisfactory results that would not have been obtained when it was done manually. The process provides the surface roughness or luster that is nearly equivalent to that obtained by the buff finishing. As works that are finished by this process will have the weight and size unchanged, the process, which was originally used to finish precious metals or stones such as lost waste castings, may be applied similarly to finishing works, such as component parts for the precision machine, electronics component parts, component parts for the medical equipment, and the like. It is found that the good results may be obtained. By designing ferromagnetic media and abrasive media as appropriate, the process may have a broad range of applications, including the finishing of works that range from soft works to extremely hard works.

The present invention provides a method and apparatus for finishing works magnetically, particularly large works magnetically and uniformly, by permitting any combination of a plurality of alternating magnetic field generator units to produce an alternating magnetic field covering an extensive region, and by eliminating any magnetic dead or inactive points between each units.

According to the present invention, a plurality of alternating magnetic field generator units may be combined to provide an extensive alternating magnetic fields. Thus, large, complicatedly configured works which could not be handled in the prior art can be processed easily. Any dimensional (cubic) works may also be processed.

Any dead or inactive points that would otherwise appear in the generated alternating magnetic fields may be removed or eliminated simply by rocking the units individually or collectively. Thus, the uniform finishing can be achieved.

EMBODIMENT 1

Figure 1:
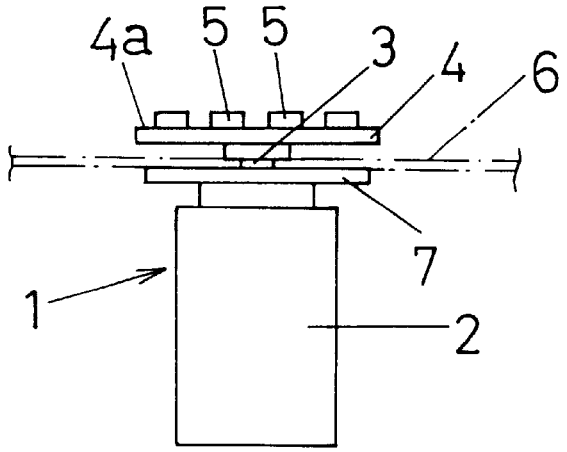
FIG. 1 is a front view of an alternating magnetic field generator unit employing the present invention.
Figure 2:
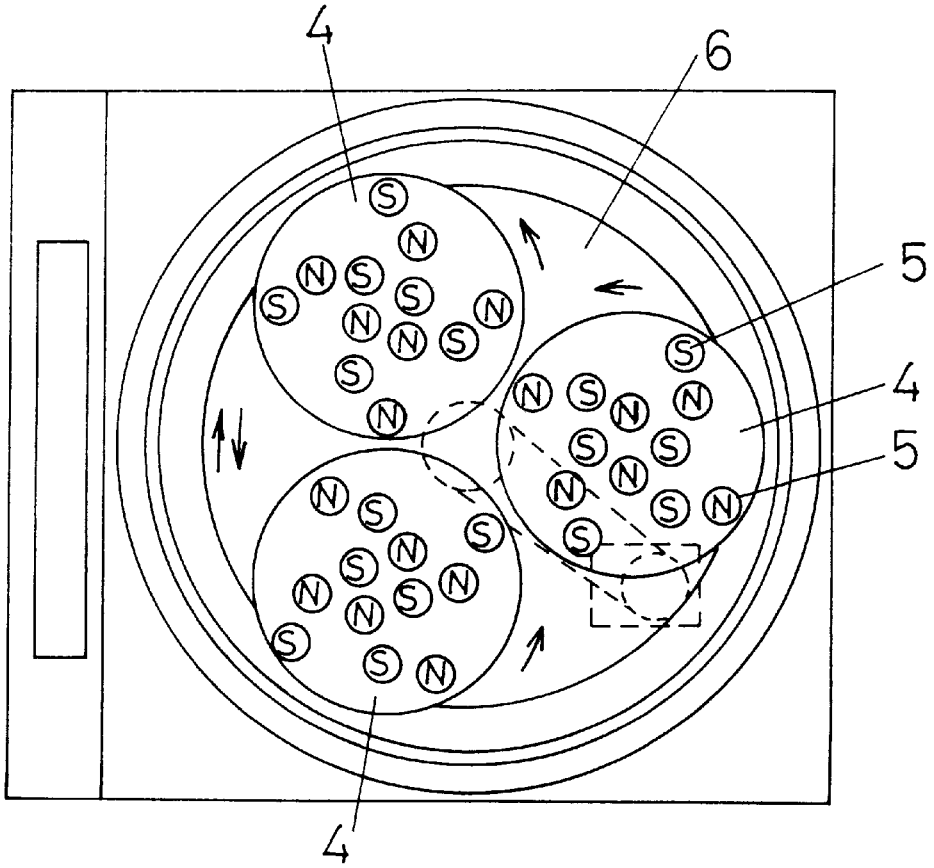
FIG. 2 is a plan view of a first embodiment of the present invention including three units with some parts omitted.
Figure 3:
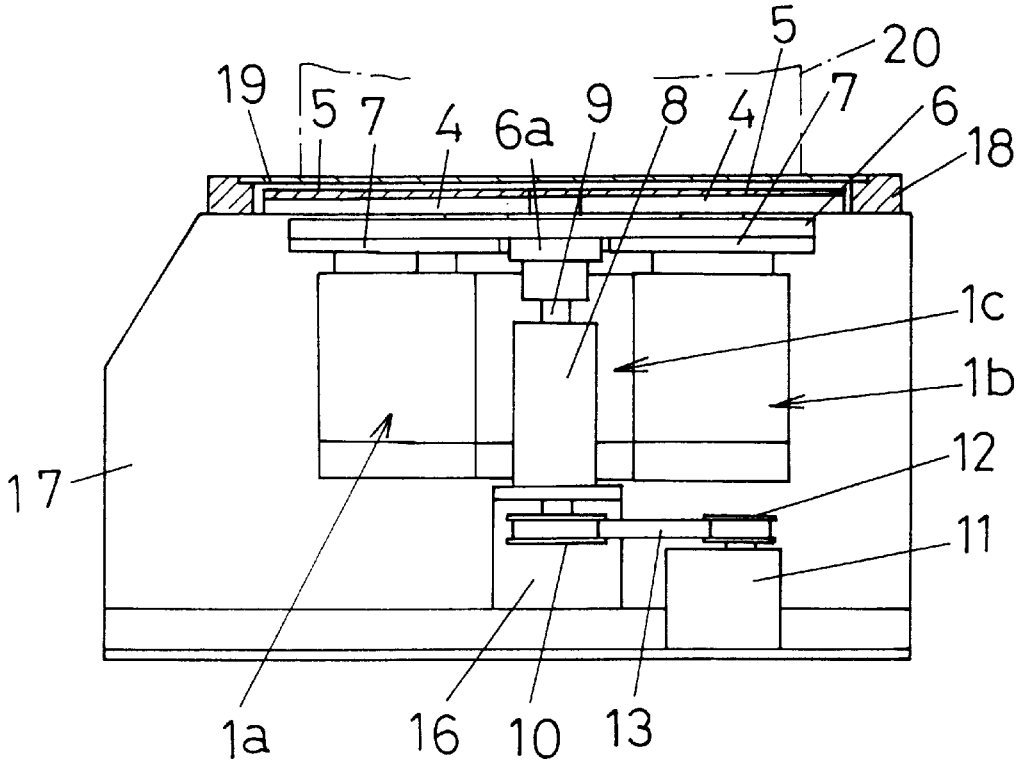
FIG. 3 is a front view of the embodiment of FIG. 2 with some parts shown in cross section.
Figure 4:
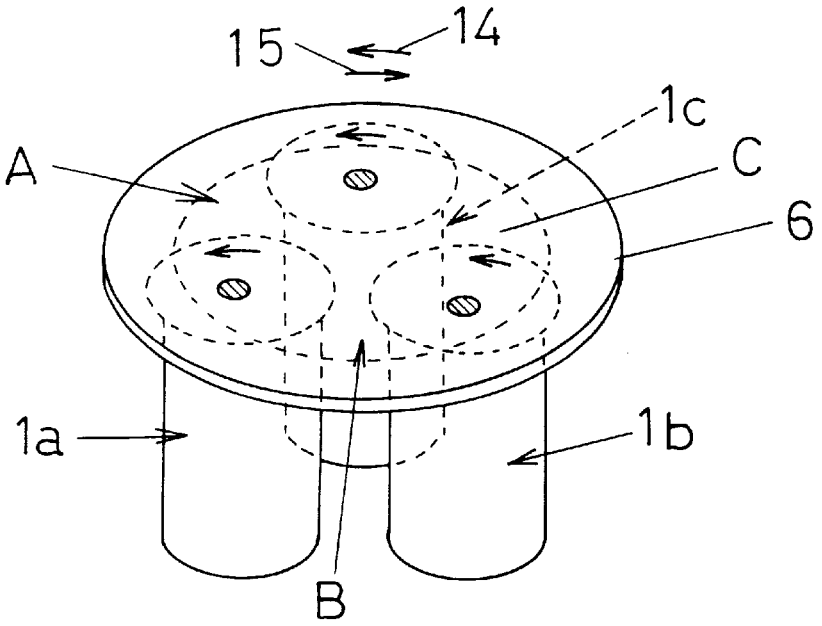
FIG. 4 is a perspective view of the embodiment of FIG. 2 including three units mounted below the disk plate.

Referring first to FIGS. 1, 2, 3, and 4, an apparatus employing the present invention is shown. As shown in FIG. 1, the apparatus comprises an alternating magnetic field generator unit, designated generally by 1, that includes a motor 2 with a shaft 3, a magnet disk (support) plate 4 fixed at tis center to the shaft 3 of the motor 2, and disk permanent magnets 5, 5, for example, three magnets as shown, mounted at regular intervals on the top face 4*a* of the magnet (support) disk plate 4. There is also a motor flange 7. The apparatus may comprise several units of identical construction as described above. Specifically, as shown in FIG. 4, three units 1*a*, 1*b*, 1*c* are rigidly mounted to the underside of a common disk plate 6 such that they are arranged concentrically at regular intervals. (The apparatus further includes means for causing a rocking motion and supported by a bearing 8 from which a shaft 9 extends, to the top end of which the disk plate 6 fixed and to the bottom end of which a pulley 10 is fixed.) The rocking means may include a rocking motor 11, and the pulley 10 and a pulley 12 mounted to the rocking motor shaft are connected by a timing belt 13. When the rocking motor 11 is rotated forwardly or reversely, it causes the disk plate 6 to have the rocking motion as shown by an arrow 14 or 15 in FIG. 4. The rocking motor shaft 9 is fastened by a bracket 16 on the machine frame 17.

In the embodiment described above, when each respective motor 2, 2 in each unit 1*a*, 1*b*, 1*c* and the rocking motor 11 are rotated forwardly or reversely, the disk plate 6 is rotated in the direction of an arrow 14 or 15, changing the positions of the magnet disk plates 4, 4 relative to each other and accordingly the relative positions of the corresponding permanent magnets 5, 5 thereon. The dead or inactive points (A, B, C in FIG. 4) that would otherwise appear in the alternating magnetic fields generated by each unit 1*a*, 1*b*, 1*c* may be eliminated. A container 20, which contains media and works being processed therewith, is placed on its stand plate 19 which is secured to the top of the upper frame 18 which is mounted above the apparatus. When the apparatus is then operated, it generated alternating magnetic fields below the container, which act upon works and media so that they can have the complicate flow motions. Under the action of the alternating magnetic fields, the works and media may interact with each other, and the works may thus be finished uniformly by the media.

Figure 5:
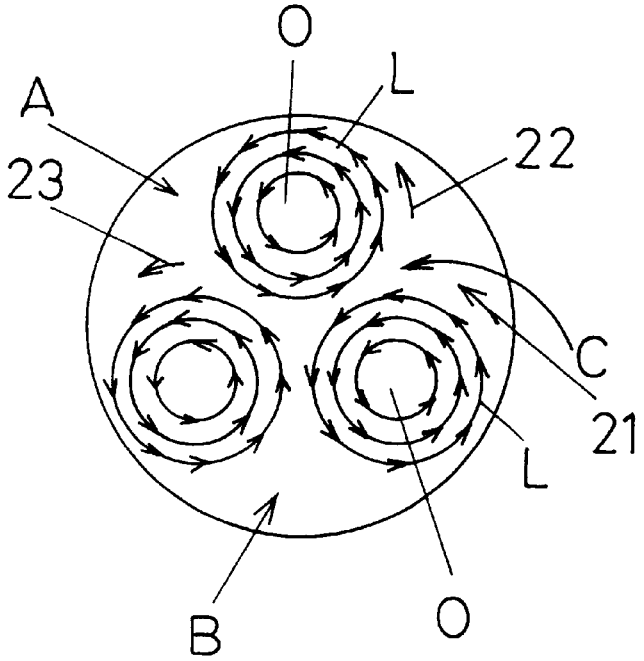
FIG. 5 explains how alternating magnetic fields are generated according to the embodiment of FIG. 2.
Figure 6:
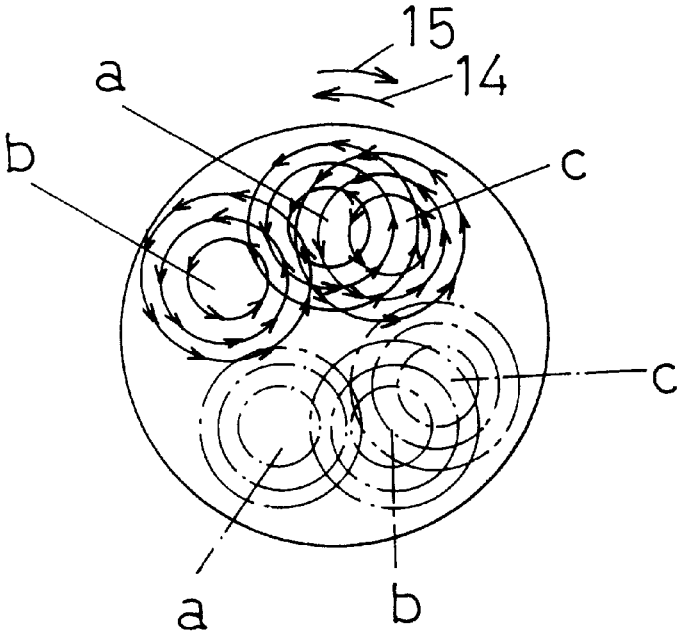
FIG. 6 explains how the alternating magnet fields may be changed by the rocking motion (for eliminating dead points) according to the embodiment of FIG. 2.

Specifically, each magnet disk plate 4 may be rotated as indicated by arrows 21, 22, 23 in FIG. 5, respectively, and may produce triple circular flows of media mass as shown in FIG. 5 by the generated alternating magnetic fields. When the disk plate 6 is then rocked, the media mass flow due to the generated respective magnetic field may be rocked from the position a to the position b, or from the position a to the position c, as shown in FIG. 6. In this case, the rocking angle may be within 120 degrees. If the outer ring L of the alternating magnetic field is shifted so that it can overlap the center O of another alternating magnetic field, the center O where the finishing power is relatively small can be increased by the powerful outer ring L over lapping the center O. In this way, any dead or inactive point at the center O can be supplemented and/or eliminated, and the total finishing power can also be adjusted and enhanced. As a total result, the uniform finishing can be achieved.

EMBODIMENT 2

Figure 7:
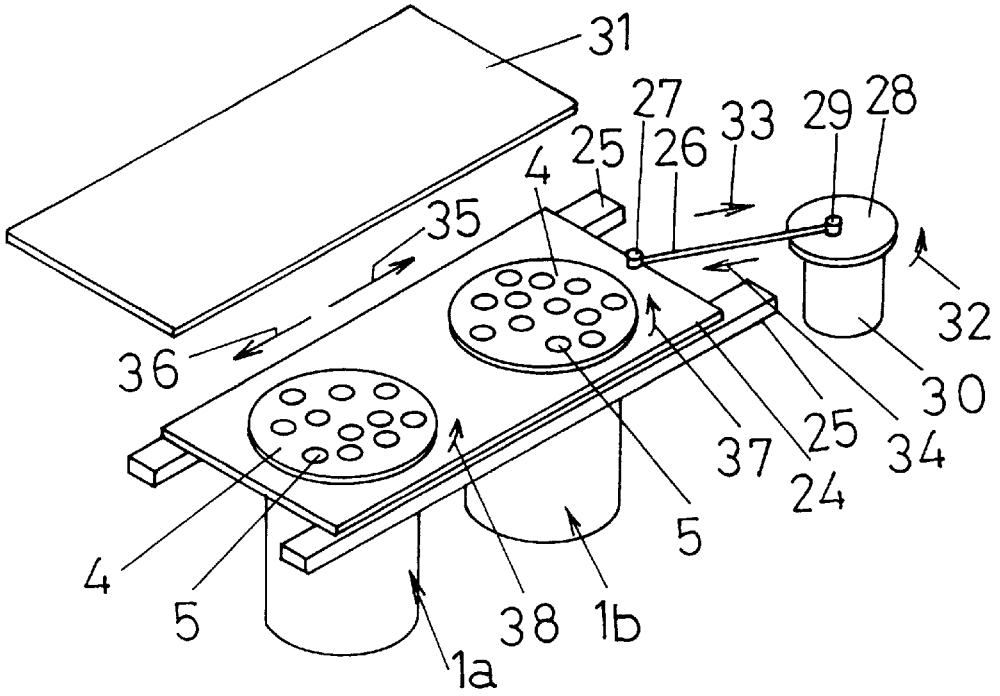
FIG. 7 is a perspective view of a second embodiment of the present invention including two units with some parts omitted.
Figure 8:
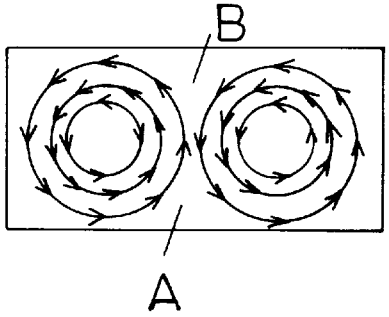
FIG. 8 explains how alternating magnetic fields are generated according to the embodiment of FIG. 7.
Figure 9:
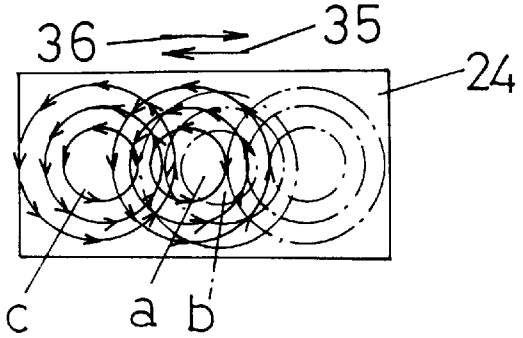
FIG. 9 explains how dead points are eliminated by the rocking motion according to the embodiment of FIG. 7.

Referring next to FIGS. 7, 8 and 9, another preferred embodiment of the present invention is described. Units 1*a*, 1*b* are mounted in parallel on the underside of a rectangular plate 24 which is placed slidably on a pair of guide rails 25, 25. The rectangular plate 24 has its one lateral side connected to one end of a connecting rod 26 by means of a pin 27. The other end of the connecting rod 26 is connected to an eccentric pin 29 on a rotating plate 28 which is secured to the shaft of a motor 30. There is a stand plate 31 on which a container having works and media therein rests.

When the rotating plate 28 is rotated as indicated by an arrow 32, the connecting rod 26 is rocked as indicated by arrows 33, 34. By this rocking motion, the rectangular plate 24 is also rocked as indicated by arrows 35, 36. When each respective motor in each unit 1*a*, 1*b* is then started up, the magnet disk plates 4, 4 are rotated as indicated by arrows 37, 38, respectively. Permanent magnets 5, 5 on each magnet disk plate 4 may generate alternating magnetic fields which cause the mass media to flow as shown in FIG. 8. When the rectangular plate 24 is rocked as indicated by arrows 35, 36, as described above, the magnet disk plates 4, 4 are also rocked in the same direction as the plate 24. During the rocking motion, the magnet disk plates 4, 4 which are also rotating may generate alternating magnetic fields, respectively. The mass media flow in this case is shown in FIG. 9. Any dead or inactive points A, B of the generated alternating magnetic fields as shown in FIG. 8 may thus be eliminated.

EMBODIMENT 3

Figure 10A:
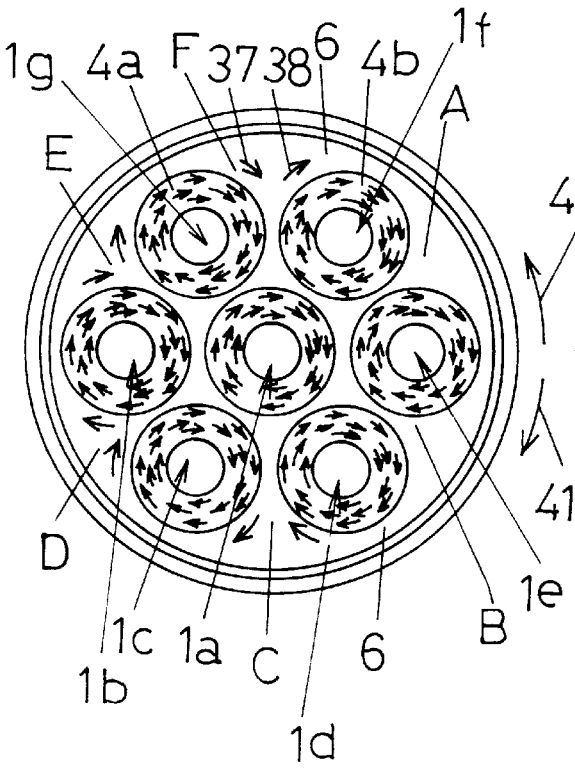
FIG. 10(*a*) and FIG. 10(*b*) show a third embodiment of the present invention including three units, in which FIG. 10(*a*) explains how alternating magnetic fields are generated, and FIG. 10(*b*) explains how the alternating magnetic fields change when each adjacent magnet plate for each unit is rotated in opposite directions.
Figure 10B:
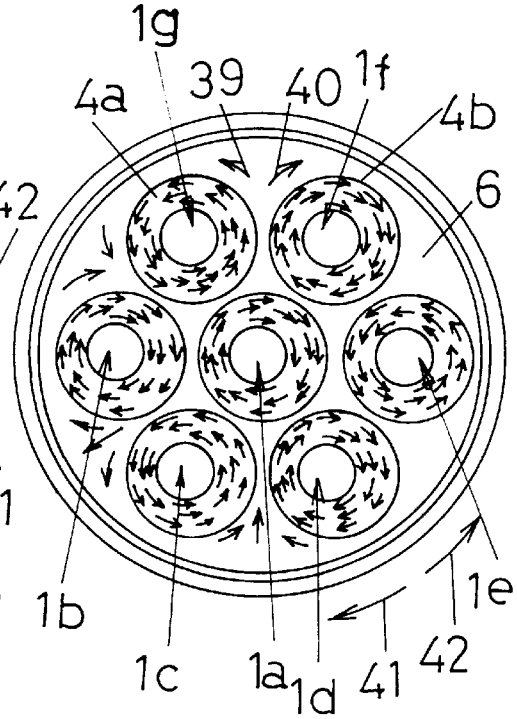

Referring next to FIG. 10(*a*) and FIG. 10(*b*), the apparatus according to a third preferred embodiment including seven units is described. A disk plate 6 carries a center unit 1*a* and other units 1*b*, 1*c*, 1*d*, 1*e*, 1*f*, 1*g* at regular intervals around the center unit 1*a*. When any adjacent magnet disk plates, such as the ones 4*a* and 4*b* are rotated in identical directions (as indicated by arrows 37, 38), alternating magnetic fields are generated as shown in FIG. 10(*a*), and when they are rotated in opposite directions (as indicated by arrows 39, 40), alternating magnetic fields are generated as shown in FIG. 10(*b*). In either case, the flow would change but there are still dead or inactive points. Those dead points A, B, C, D, E, F may be removed as completely as possible by rocking the disk plate 6 forwardly or reversely as shown by arrow 41 or 42, respectively. The embodiment shown in FIG. 10(*a*) and FIG. 10(*b*) is specifically designed to finish large works. In FIG. 10(*a*) and FIG. 10(*b*) it is shown that all of the adjacent magnet disk plates rotate consistently, such as in the same direction. It is noted that this is only an example, but they may be rotated consistently or inconsistently, depending on the particular needs, so that complex alternating magnetic fields may be provided, and complex mass media flow may be produced accordingly. It is also noted that it is necessary to ensure that they do not rotate too fast. Otherwise, media or works could not follow the rotation or the flow of the magnetic flux would be disturbed. If such situation occurs, the finishing efficiency would be affected.

EMBODIMENT 4

Figure 11:
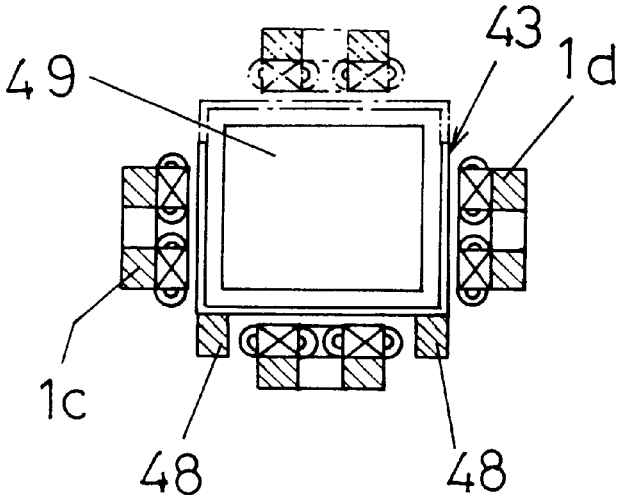
FIG. 11(*a*) and FIG. 11(*b*) shows a fourth embodiment of the present invention, in which FIG. 11(*a*) is a front view showing that each individual unit is mounted to vertical lateral sides of a frame box, and FIG. 11(*b*) is a perspective view of the same with some parts omitted.
Figure 11:
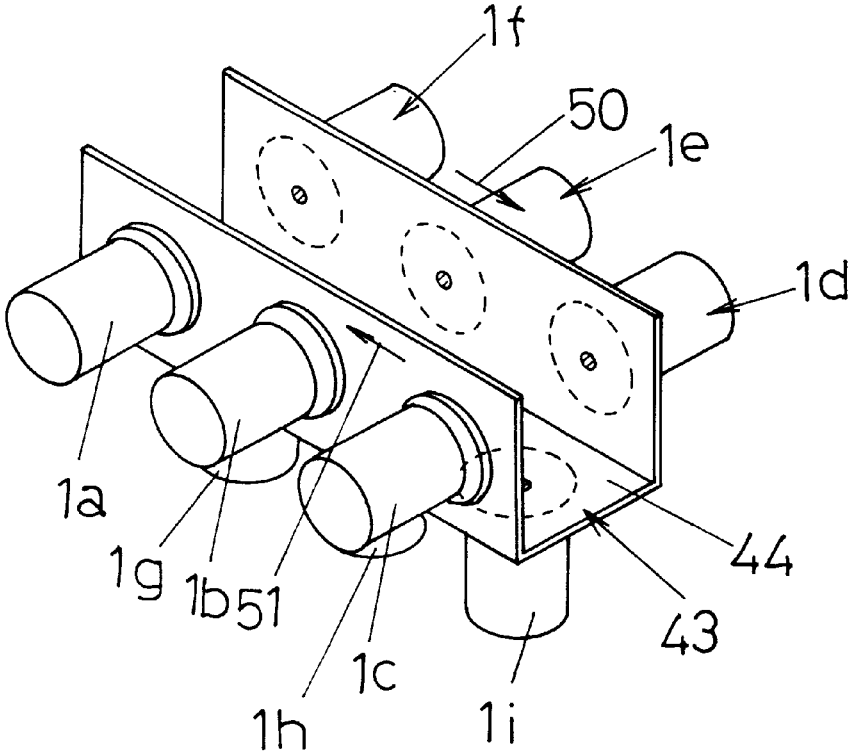
Figure 12A:
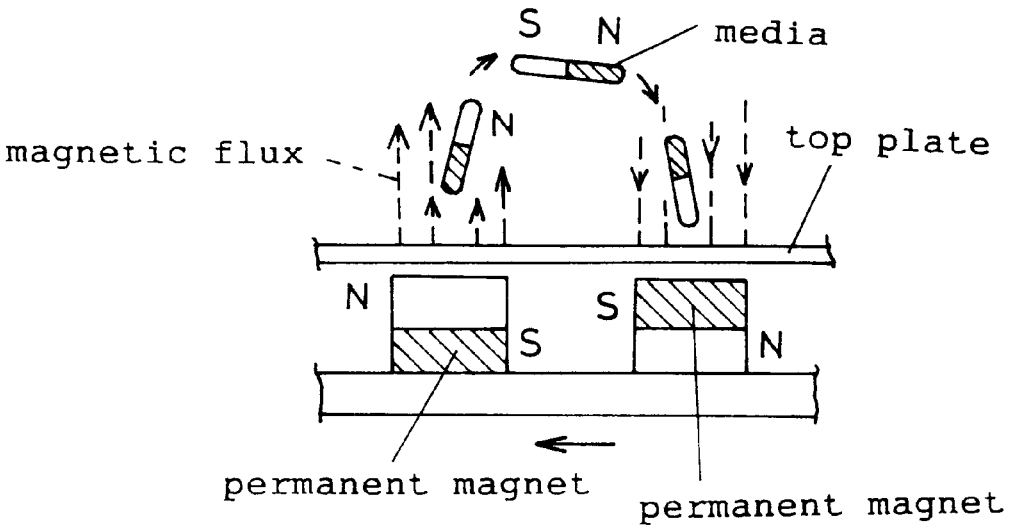
FIG. 12(*a*) explains how pins as ferromatic media are moving, and FIG. 12(*b*) explains how the pins impinge upon a work in the typical case according to the present invention.
Figure 12B:
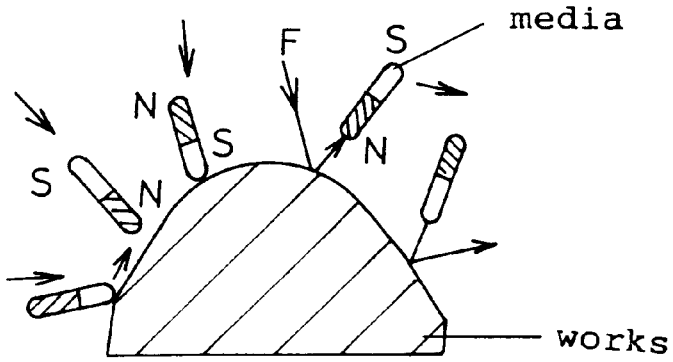
Figure 13:
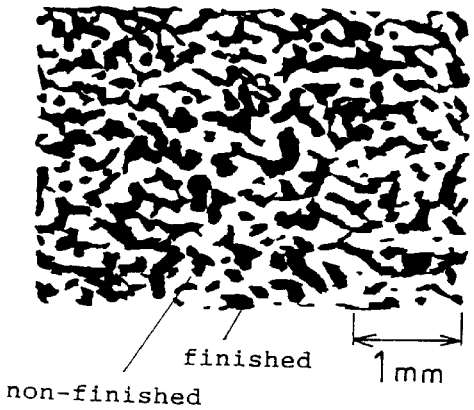
FIG. 13 shows an example of the results of the work impinged upon by the pins for two minutes according to the present invention (impinged parts indicated by the dark)
Figure 14A:
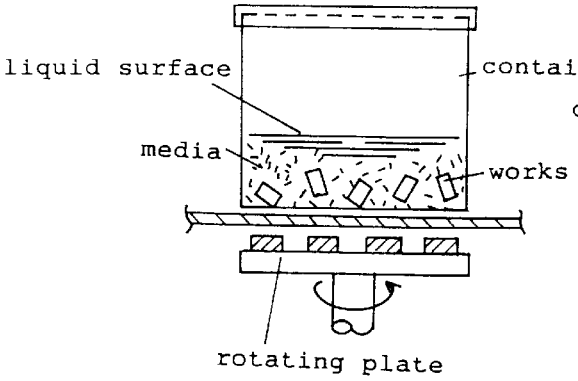
FIG. 14(*a*) explains how alternating magnet fields are generated by using permanent magnets, and FIG. 14(*b*) explains how alternating magnetic fields are generated by using electromagnets.
Figure 14B:
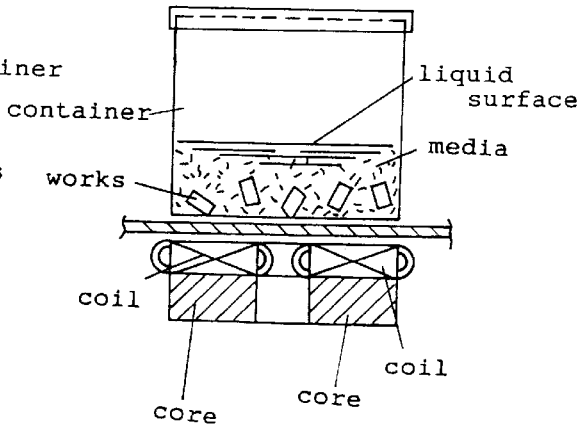
Figure 15:
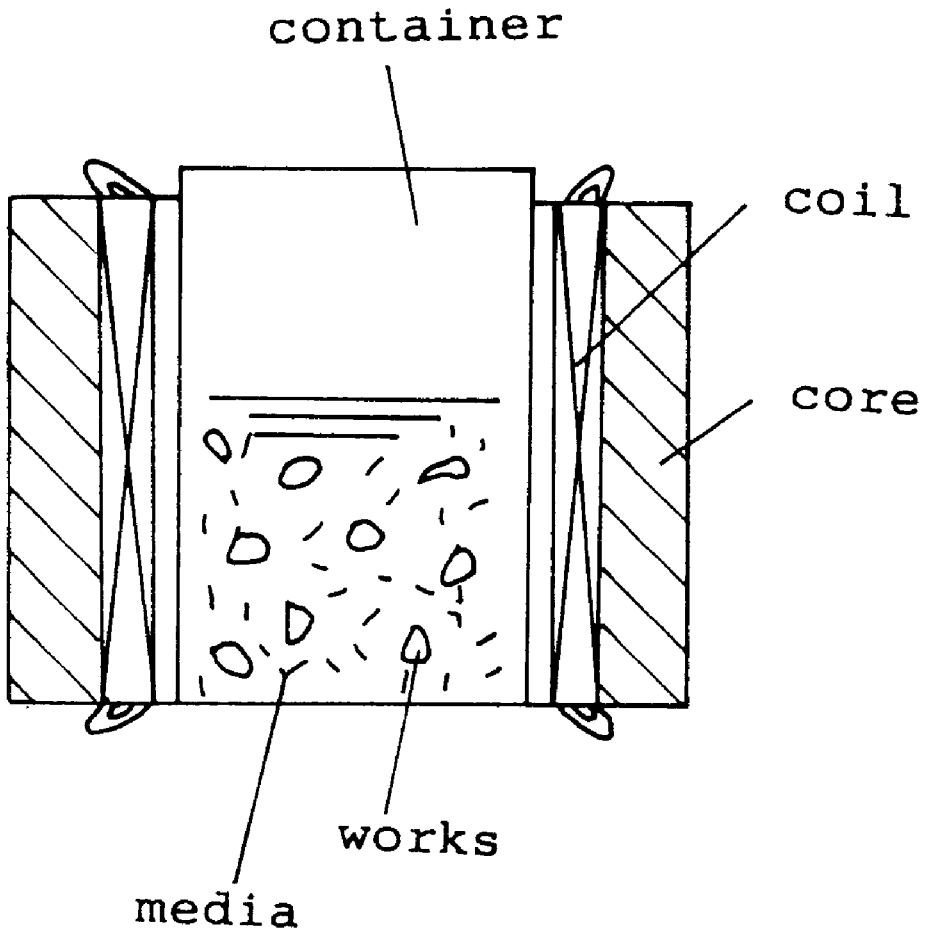
FIG. 15 explans how alternating magnetic fields are generated by using cylindrical electromagnets according to a variation of the present invention.
Figure 16A:
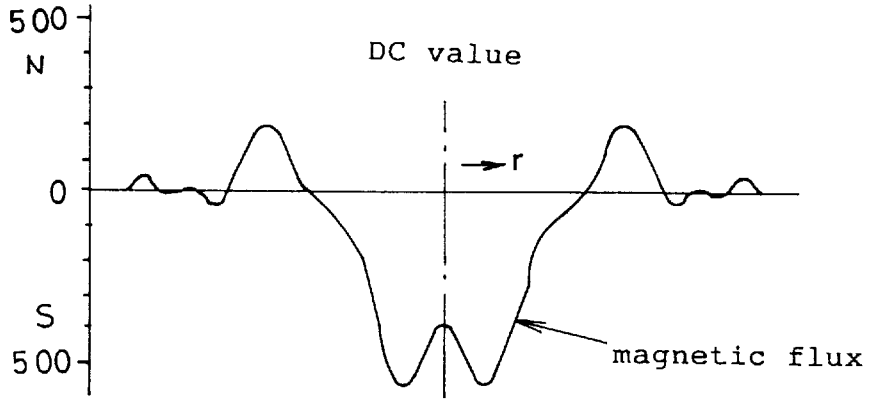
FIG. 16(*a*) is a graph showing changes in the magnetic flux density as the permanent magnet disk plate is rotating, and FIG. 16(*b*) is a graph showing the RMS values for the magnetic flux density.
Figure 16B:
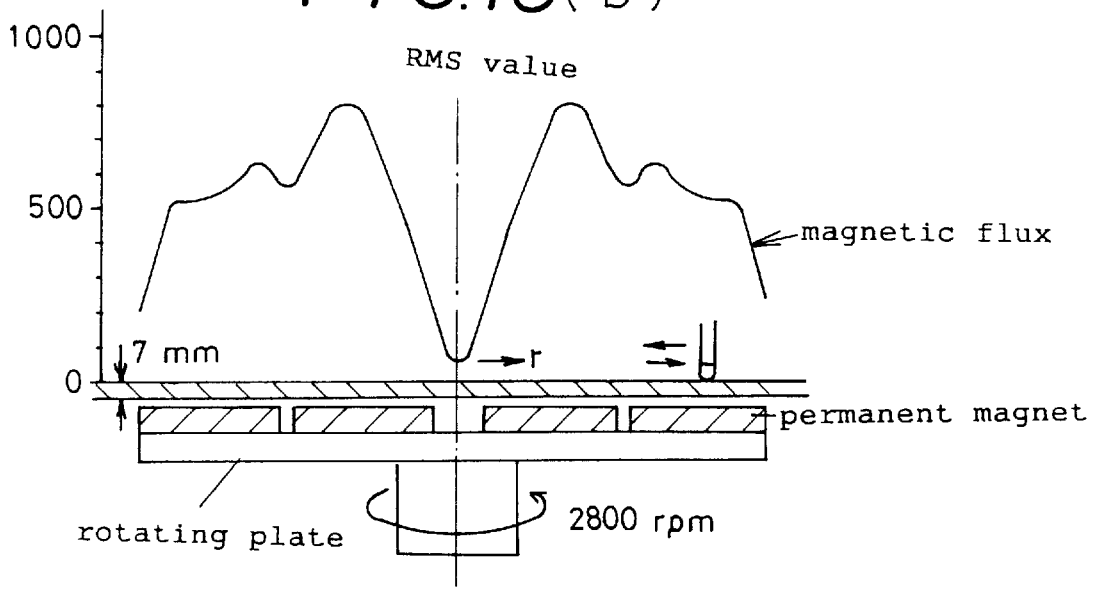
Figure 17A:
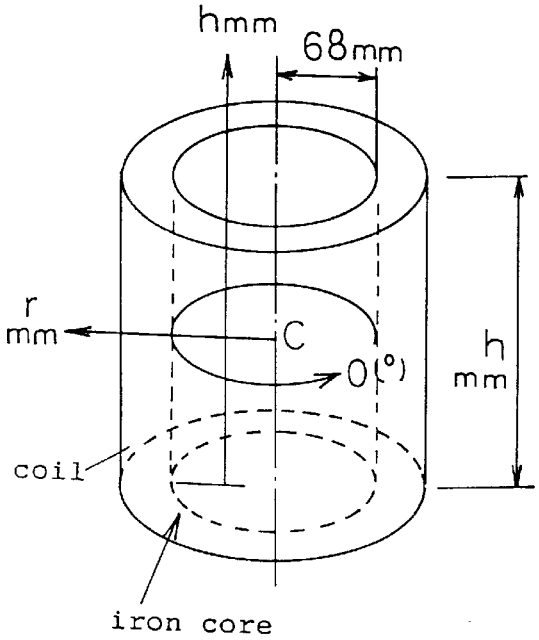
FIG. 17(*a*) explains how the magnetic flux occurs for the cylindrical electromagnet, and FIG. 17(*b*) is the histogram for the magnetic strength.
Figure 17B:
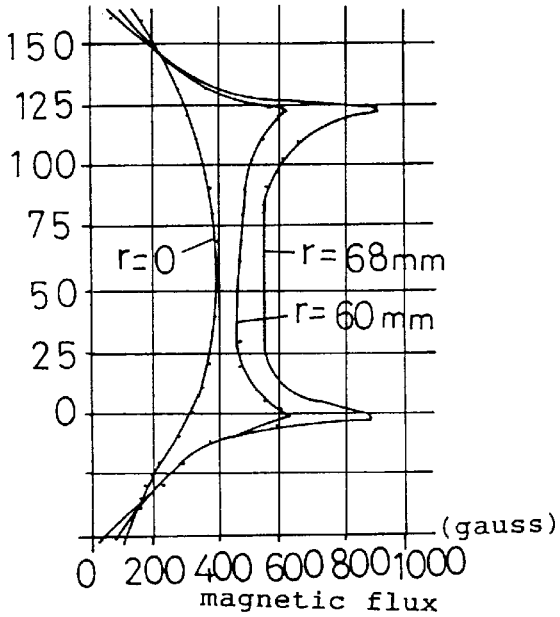

The embodiment shown in FIG. 11(*a*) and FIG. 11(*b*) includes a different combination of the units. A frame structure 43 open on one side has nine units 1*a*, 1*b*, 1*c*, 1*d*, 1*e*, 1*f*, 1*g*, 1*h*, 1*i*, every three units being mounted to the lateral sides and bottom of frame structure 43 as shown in FIG. 11(*b*). A pair of guide rails is designated by 48, and a container having works and media therein is designated by 49 as shown in FIG. 11(*a*).

In each of the preceding and current embodiments, the plurality of units are rocked by the rocking plate to provide extensive alternating magnetic fields. One group may consist of several units, and several such groups may be provided to generate extensive alternating magnetic fields. In such cases, those units may be controlled on each individual unit basis, each individual group basis, or both. The control may be complicated, but a microprocessor-based computer may be programmed to control those different operations, depending upon the particular requirements such as they type of works being processed. Thus, the full automatic finishing operation may be achieved.

According to the current embodiment 4, an elongated work may be moved successively from one end toward the other to pass through different stages, such as rough finishing, intermediate finishing, and final precision finishing.

EMBODIMENT 5

Figure 18:
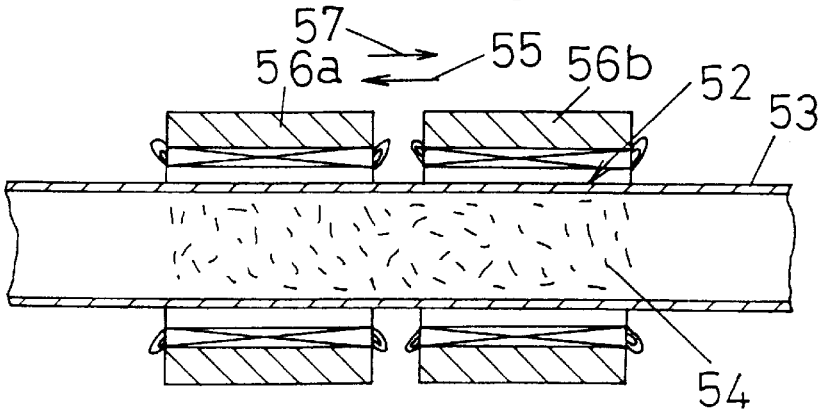
FIG. 18 is a cross section of a fifth embodiment of the present invention, showing how mental tubes are finished by using the cylindrical electromagnets.

The embodiment shown in FIG. 18 is specifically designed to process cylindrical works, more particularly, the internal side of such work. Cylindrical electromagnets 56*a*, 56*b* are arranged in parallel, and they may provide composite alternating magnetic fields 52. The cylindrical electromagnets may accept a work, such as a metal tube 53, through their respective bores. The metal tube 53 contains a media mass 54 (such as pins as media, compound, etc.). The metal tube 53 may be moved intermittently or continuously as indicated by an arrow 55 or 57. The traveling speed may be varied, depending upon the type of work, the desired finishing quality and the like. Typically, it may be set to 10 cm to 50 cm/min.

In this embodiment, the media mass will stay within the generated alternating magnetic fields. Thus, there is no need of providing means to keep it within the magnetic fields.

EMBODIMENT 6

Figure 19:
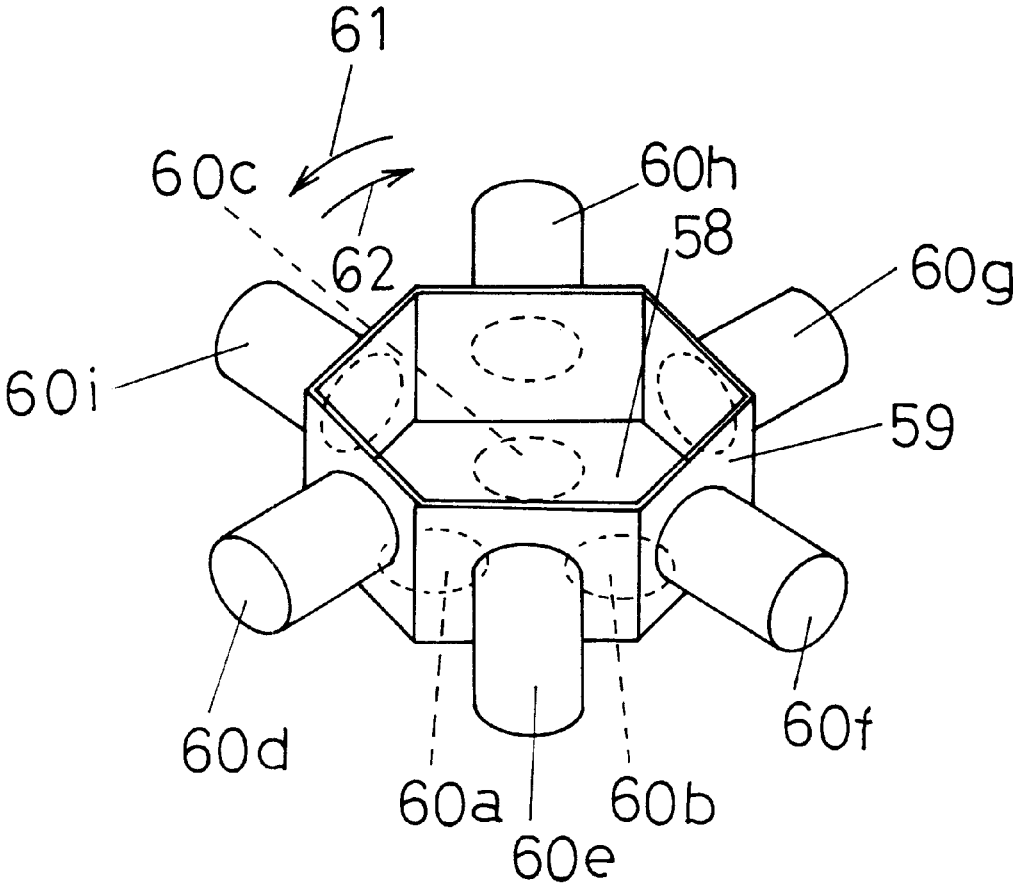
FIG. 19 is a perspective view of a sixth embodiment of the present invention.

Referring next to FIG. 19, a sixth preferred embodiment is described. As shown, a hexagonal frame structure 59 has a six sides and a bottom plate 58, with the other or top side open. Three units 60*a*, 60*b* and 60*c* are arranged like an triangle and are secured to the bottom side of plate 58, and each of the remaining units 60*d*, 60*e*, 60*f*, 60*g*, 60*h*, 60*i* is secured to each respective six sides.

According to this arrangement, when the hexagonal frame structure 59 is rocked reciprocatingly as indicated by arrows 61, 62, the media mass within the hexagonal frame structure 59 may be subject to the complex, dimensional (cubic) flow motion which permits works to be finished uniformly.

Although the present invention has so far been described with reference to some particular embodiments thereof, it should be understood that various changes and modifications may be made without departing from the spirit and scope of the invention as defined in the appended claims.

What is claimed is:

1. A method of magnetically finishing work pieces, comprising:

establishing a plurality of separate alternating magnetic fields;

combining the separate alternating magnetic fields so as to cover a specific area therewith; and placing a mass of media and work pieces to be processed in free motion within the specific area during said combining so as to finish the work pieces.

2. The method of claim 1, wherein said establishing comprises individually rotating a plurality of separate magnet disk plates, each of said disk plates having a plurality of permanent magnets thereon.

3. The method of claim 2, wherein said combining comprises displacing said plurality of separate disk plates while said disks are rotating.

4. The method of claim 3, wherein said displacing comprises cyclically moving the separate disk plates together in a plane parallel to the disk plates.

5. The method of claim 2, wherein said combining comprises displacing each the separate disk plates together so that each of the separate disk plates move from a first position to a second position wherein the second position of each of the separate disk plates overlaps the first position of another of the separate disk plates.

6. The method of claim 1, wherein said combining comprises moving the separate alternating magnetic fields so that first and second of the separate alternating magnetic fields move from a first position to a second position wherein the second position of the first of the separate alternating magnetic fields overlaps the first position of the second of the alternating magnetic fields.

7. An apparatus for magnetically finishing work pieces, comprising:

a plurality of alternating magnetic field generator units, each of said generator units including a plurality of magnets mounted on a rotating plate, and said plurality of alternating magnetic field generator units being arranged in parallel so as to be able to generate respective alternating magnetic fields in a specific area, wherein the specific area can receive a mass of media and works to be processed; and means for changing the relative location of said generator units and the mass media for combining the alternating magnetic fields of said generator units.

8. The apparatus of claim 7, wherein said plurality of alternating magnetic field generator units are mounted on a common support plate and said means for changing the relative position includes a device for at least one of rocking the rotating said common support plate.

* * * * *